US011739405B2

(12) United States Patent
Arayama

(10) Patent No.: US 11,739,405 B2
(45) Date of Patent: Aug. 29, 2023

(54) PRODUCTION METHOD OF AL—MG—SI SERIES ALUMINUM ALLOY FORGED PRODUCT

(71) Applicant: SHOWA DENKO K.K., Tokyo (JP)

(72) Inventor: Takuya Arayama, Fukushima (JP)

(73) Assignee: SHOWA DENKO K.K., Tokyo (JP)

( * ) Notice: Subject to any disclaimer, the term of this patent is extended or adjusted under 35 U.S.C. 154(b) by 72 days.

(21) Appl. No.: 17/197,238

(22) Filed: Mar. 10, 2021

(65) Prior Publication Data

US 2021/0301383 A1 Sep. 30, 2021

(30) Foreign Application Priority Data

Mar. 11, 2020 (JP) ..... 2020-042002

(51) Int. Cl.
*C22F 1/043* (2006.01)
*C22C 21/02* (2006.01)

(52) U.S. Cl.
CPC ..... *C22F 1/043* (2013.01); *C22C 21/02* (2013.01)

(58) Field of Classification Search
CPC .. C22F 1/043; C22F 1/047; C22F 1/05; C22C 21/02; C22C 21/08
See application file for complete search history.

(56) References Cited

U.S. PATENT DOCUMENTS 5,961,752 A * 10/1999 Bergsma ..... C22C 21/08 148/552
2013/0164170 A1* 6/2013 Nakai ..... C22C 21/06 420/532
2017/0247782 A1* 8/2017 Matsumoto ..... C22C 21/02

FOREIGN PATENT DOCUMENTS

JP H0559477 A 3/1993
JP H05247574 A 9/1993
JP H06256880 A 9/1994

OTHER PUBLICATIONS

English Abstract of JPH0559477, Publication Date: Mar. 9, 1993.
English Abstract of JPH05247574, Publication Date: Sep. 24, 1993.
English Abstract of JPH06256880, Publication Date: Sep. 13, 1994.

* cited by examiner

*Primary Examiner* — Brian D Walck
*Assistant Examiner* — Nazmun Nahar Shams
(74) *Attorney, Agent, or Firm* — Millen White Zelano and Branigan, PC; Csaba Henter

(57) ABSTRACT

A method of producing an Al—Mg—Si-based aluminum alloy forged product, includes a solution heat treatment step of performing a solution heat treatment for heating the forged product obtained in the forging step at a temperature rising rate of 5.0° C./min or more from 20° C. to 500° C. and holding the forged product at 530° C. to 560° C. for 0.3 hours to 3 hours, a quench treatment step of quenching the forged product in a water tank by bringing an entire surface of the forged product into contact with quenching water within 5 seconds to 60 seconds after the solution heat treatment step for more than 5 minutes and not more than 40 minutes, and an aging treatment step of performing an aging treatment by heating the forged product after the quench treatment step at a temperature of 180° C. to 220° C. for 0.5 hours to 1.5 hours.

18 Claims, 1 Drawing Sheet

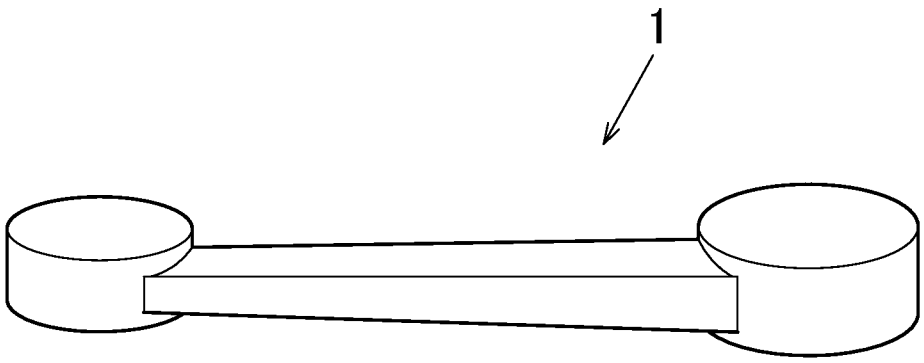
1

PRODUCTION METHOD OF AL—MG—SI SERIES ALUMINUM ALLOY FORGED PRODUCT

TECHNICAL FIELD

The present invention relates to a production method of an Al—Mg—Si series aluminum alloy forged product excellent in mechanical properties at room temperature.

BACKGROUND OF THE INVENTION

In recent years, an aluminum alloy has been expanding its application as a structural member for various products by taking advantage of its lightness. For example, although high tensile strength steel has been used for an automobile suspension member and a bumper component, high strength aluminum alloy materials have become used in recent years. For automobile components, such as, e.g., a suspension member, ferrous materials were mostly used. However, for the main purpose of attaining the weight reduction, ferrous materials have been often replaced with aluminum or aluminum alloy materials.

Since these automobile components are required to be excellent in corrosion resistance, high in strength, and excellent in workability, an Al—Mg—Si-based alloy, in particular an A6061 alloy, has become used as such an aluminum alloy material. In order to improve the strength of such an automobile component, such an automobile component is produced by performing a forging process which is one of plastic working using an aluminum alloy material as a blank material to be processed.

Further, since cost reduction has to be attempted recently, suspension components obtained by forging a cast member as a blank material without extrusion and then subjecting it to a T6 treatment have begun to be put into practical use. For a further weight reduction, a high strength alloy alternative to a conventional A6061 material is being developed (see Patent Documents 1 to 3 listed below).

PRIOR ART DOCUMENT

Patent Document

PATENT DOCUMENT 1: Japanese Unexamined Patent Application Publication No. H05-59477

PATENT DOCUMENT 2: Japanese Unexamined Patent Application Publication No. H05-247574

PATENT DOCUMENT 3: Japanese Unexamined Patent Application Publication No. H06-256880

SUMMARY OF THE INVENTION

Problems to be Solved by the Invention

However, in the above-described Al—Mg—Si-based high-strength alloy, the processing structure is recrystallized in the forging step and the heat treatment step, which generates coarse crystal grains. Therefore, there is a problem that a sufficiently high strength cannot be obtained. Therefore, in order to prevent generation of coarse crystal grains, in some alloys, Zr is added to prevent recrystallization (for example, Patent Documents 1 and 2).

However, although adding Zr is effective in preventing recrystallization, there are the following problems.

(1) Adding Zr weakens the crystal grain refinement effect of an Al—Ti—B-based alloy and coarsens crystal grains of the casting itself. This results in a decreased strength of the workpiece (forged product) after plastic working.

(2) Since the crystal grain refinement effect of the casting itself is weakened, casting cracking is likely to occur, increasing the internal defects, which deteriorates the yield.

(3) Zr forms compounds with an Al—Ti—B-based alloy. The compounds deposit on the bottom of the furnace for storing a molten alloy metal and contaminate the furnace. In the produced casting, the compounds coarsely crystallize in the casting, reducing the strength.

As described above, although adding Zr is effective in preventing recrystallization, it was difficult to maintain the strength stability.

Preferred embodiments of the present invention have been made in view of the above-described and/or other problems in the related art. Preferred embodiments of the present invention can significantly improve upon existing methods and/or devices.

The present invention has been made in view of the above-described technical background, and the object of the present invention is to provide a production method of an Al—Mg—Si-based aluminum alloy forged product excellent in mechanical properties at room temperature and hardly occurring recrystallized grains.

Other objects and advantages of the present invention will be apparent from the following preferred embodiments.

Means for Solving the Problem

In order to achieve the above-described objects, the present invention provides the following means.

[1] A method of producing an Al—Mg—Si-based aluminum alloy forged product, comprising:

a molten metal forming step of obtaining a molten metal of a 6,000 series aluminum alloy;

a casting step of obtaining a casting by casting the molten metal obtained in the molten metal forming step;

a homogenization heat treatment step of performing a homogenization heat treatment for holding the casting obtained in the casting step at a temperature of 370° C. to 560° C. for 4 hours to 10 hours;

a forging step of obtaining a forged product by subjecting the casting after the homogenization heat treatment step to a forging process at a heating temperature of 450° C. to 560° C.;

a solution heat treatment step of performing a solution heat treatment for heating the forged product obtained in the forging step at a temperature rising rate of 5.0° C./min or more from 20° C. to 500° C. and holding the forged product at 530° C. to 560° C. for 0.3 hours to 3 hours;

a quench treatment step of quenching the forged product in a water tank by bringing an entire surface of the forged product into contact with quenching water within 5 seconds to 60 seconds after the solution heat treatment step for more than 5 minutes and not more than 40 minutes; and an aging treatment step of performing an aging treatment by heating the forged product after the quench treatment step at a temperature of 180° C. to 220° C. for 0.5 hours to 1.5 hours.

[2] The method of producing an Al—Mg—Si-based aluminum alloy forged product as recited in the above-described Item [1], wherein the molten metal of the 6,000 series aluminum alloy consists of: Cu: 0.15 mass % to 1.0 mass %; Mg: 0.6 mass % to 1.15 mass %; Si: 0.95 mass % to 1.25 mass %; Mn: 0.4 mass % to 0.6 mass %; Fe: 0.2 mass % to 0.3 mass %; Cr: 0.11 mass % to 0.25 mass %; Ti: 0.012 mass % to 0.035 mass %; B: 0.0001 mass % to 0.03 mass %; Zn: 0.25 mass % or less; Zr: 0.05 mass % or less; and the balance being Al and inevitable impurities.

[3] The method of producing an Al—Mg—Si-based aluminum alloy forged product as recited in the above-described [2], wherein a content rate of the Zn is 0 mass %.

[4] The method of producing an Al—Mg—Si-based aluminum alloy forged product as recited in the above-described Item [2], wherein a content rate of Zr is 0 mass %.

[5] The method of producing an Al—Mg—Si-based aluminum alloy forged product as recited in as recited in the above-described Item [3], wherein a content rate of Zr is 0 mass %.

[6] The method of producing an Al—Mg—Si-based aluminum alloy forged product as recited in any one of the above-described Items [1] to [5], wherein the forged product is an automobile suspension member.

Effects of the Invention

According to the invention as recited in the above-described Item [1], by performing the solution heat treatment step of performing a solution heat treatment for heating the forged product obtained in the forging step at a temperature rising rate of 5.0° C./min or more from 20° C. to 500° C. and holding the forged product at 530° C. to 560° C. for 0.3 hours to 3 hours; the quench treatment step of quenching the forged product in a water tank by bringing an entire surface of the forged product into contact with quenching water within 5 seconds to 60 seconds after the solution heat treatment step for more than 5 minutes and not more than 40 minutes; and the aging treatment step of performing an aging treatment by heating the forged product after the quench treatment step at a temperature of 180° C. to 220° C. for 0.5 hours to 1.5 hours, it is possible to produce an Al—Mg—Si-based aluminum alloy forged product excellent in mechanical properties at room temperature and hardly occurring recrystallized grains.

According to the invention as recited in the above-described Items [1] to [5], since the alloy composition is limited, it is possible to produce an Al—Mg—Si-based aluminum alloy forged product excellent in mechanical properties at room temperature and hardly occurring recrystallized grains.

According to the invention as recited in the above-described Item [6], it is possible to produce an Al—Mg—Si-based aluminum alloy forged product used as an automobile suspension member excellent in mechanical properties at room temperature and hardly occurring recrystallized grains.

BRIEF DESCRIPTION OF THE DRAWINGS

FIG. 1 is a perspective view of an aluminum alloy forged product obtained by a production method of the present invention.

EMBODIMENTS FOR CARRYING OUT THE INVENTION

A production method of an Al—Mg—Si-based aluminum alloy forged product according to the present invention will be described.

Note that the embodiments described below are merely illustrative, and the present invention is not limited to the embodiments and can be appropriately modified without departing from the technical concept of the present invention.

In this embodiment, a molten metal forming step, a casting step, a homogenization heat treatment step, a forging step, a solution heat treatment step, a quench treatment step, and an aging treatment step are performed in this order to produce an aluminum alloy forged product 1, for example, as shown in FIG. 1. Hereinafter, each of these steps will be described.

(Molten Metal Forming Step)

The molten metal forming step is a step of obtaining an aluminum alloy molten metal prepared by dissolving raw materials and adjusting the composition.

In this embodiment, a 6,000 series aluminum alloy molten metal is obtained (prepared) in which it consists of: Cu: 0.15 mass % to 1.0 mass %; Mg: 0.6 mass % to 1.15 mass %; Si: 0.95 mass % to 1.25 mass %; Mn: 0.4 mass % to 0.6 mass %; Fe: 0.2 mass % to 0.3 mass %; Cr: 0.11 mass % to 0.25 mass %; Ti: 0.012 mass % to 0.035 mass %; B: 0.0001 mass % to 0.03 mass %; Zn: 0.25 mass % or less; Zr: 0.05 mass % or less; and the balance being Al and inevitable impurities. In this aluminum alloy molten metal, the Zn content rate may be 0 mass % (Zn-free). The Zr content rate may be 0 mass % (Zr-free).

(Casting Step)

The casting step is a step of obtaining a casting by casting the aluminum alloy molten metal obtained the molten metal forming step.

Although a continuous casting method for obtaining a casting is not specifically limited, various known continuous casting methods (a vertical type continuous casting method, a horizontal type continuous casting method, etc.) can be exemplified. As a vertical type continuous casting method, a hot-top casting method or the like is used. Hereinafter, a case in which an aluminum alloy continuously cast material is produced by a hot-top casting method using a hot-top casting apparatus (i.e., a case in which an aluminum alloy continuously cast material is produced by continuously casting an aluminum alloy molten metal by a hot-top casting method) will be briefly described as an exemplary continuous casting method.

A hot-top casting apparatus is provided with a mold (a casting mold), a molten metal receptor (header), etc. The mold is cooled by cooling water filled inside thereof. The receptor is generally made of a refractory material and is placed on top of the mold. The aluminum alloy molten metal in the receptor is injected downward into the cooled mold, cooled and solidified by the cooling water spouted from the mold at a predetermined cooling rate, and further immersed in water (the temperature: about 20° C.) in the water tank to be completely solidified. With this, an elongated continuously cast material of a rod shape or the like can be obtained.

(Homogenization Heat Treatment Step)

The homogenization heat treatment step is a step of homogenizing the microsegregation caused by solidification, depositing the supersaturated solid solution elements, and converting the metastable phase to the equilibrium phase by subjecting the casting obtained in the casting step to a homogenization heat treatment.

In this embodiment, the casting obtained in the casting step is subjected to a homogenization heat treatment for holding the casting at a temperature of 370° C. to 560° C. for 4 hours to 10 hours. By performing the homogenization heat treatment within the temperature range, the homogenization of the casting and the incorporation of the solution atom can be performed adequately, and therefore adequate strength can be obtained by the subsequent aging treatment.

(Forging Step)

The forging step is a step of heating the forging obtained after the homogenization heat treatment step and die-molding by pressurizing it with a press machine.

In this embodiment, the casting after the homogenization heat treatment is subjected to the forging step at a heating temperature of 450° C. to 560° C. to obtain a forged product (e.g., an automobile suspension arm component or the like). At this time, the starting temperature of the forged product of the forging blank is set to 450° C. to 560° C. This is because when the starting temperature is less than 450° C., the deformation resistance becomes high, preventing sufficient processing. While, when it exceeds 560° C., it is likely to occur defects, such as, e.g., forging cracks and eutectic melting.

(Solution Heat Treatment Step)

The solution heat treatment step is a step of relaxing the distortion introduced in the forging step and performing solid solution of solute elements.

In this embodiment, the solution heat treatment is performed by lowering the temperature of the forged product after the forging step to 20° C., then starting heating when the temperature of the forged product has become room temperature, constantly raising the temperature within the entire temperature range from 20° C. to 500° C. at the temperature rising rate of 5.0° C./min or more, and holding it 530° C. to 560° C. for 0.3 hours to 3 hours.

This is because when the temperature rising rate is less than 5.0° C./min, $Mg_2Si$ will precipitate coarsely. When the processing temperature is less than 530° C., the solution treatment will not proceed, preventing high strengthening by age precipitation. When the processing temperature exceeds 560° C., although the solid solution of the solute element will be promoted, eutectic melting and recrystallization will be likely to occur.

(Quench Treatment Step)

The quench treatment step is a heat treatment for forming a supersaturated solid solution by rapidly cooling the solid solution state obtained in the solution heat treatment step.

In this embodiment, the entire surface of the forged product is brought into contact with the quenching water within 5 seconds to 60 seconds after the solution heat treatment to perform the quench treatment in the water tank for more than 5 minutes and not longer than 40 minutes.

(Aging Treatment Step)

The aging treatment step is a heat treatment for imparting an appropriate hardness by heating and holding an aluminum alloy forged product at a relatively low temperature to precipitation an element solid-dissolved in supersaturation.

In this embodiment, the forged product after the quench treatment step is heated at the temperature of 180° C. to 220° C. for 0.5 hours to 1.5 hours to perform the aging treatment. When the processing temperature is lower than 180° C. or the processing time is less than 0.5 hours, a $Mg_2Si$ system precipitate for improving the tensile strength cannot be sufficiently grown. When the processing temperature exceeds 220° C., the $Mg_2Si$ system precipitate becomes too coarse. Thus, the tensile strength cannot be improved sufficiently.

As described above, the production method of the Al—Mg—Si based aluminum alloy forged product according to the present invention performs: the solution heat treatment step of performing a solution heat treatment for heating the forged product obtained in the forging step at a temperature rising rate of 5.0° C./min or more from 20° C. to 500° C. and holding the forged product at 530° C. to 560° C. for 0.3 hours to 3 hours; the quench treatment step of quenching the forged product in a water tank by bringing the entire surface of the forged product into contact with quenching water within 5 seconds to 60 seconds after the solution heat treatment step for more than 5 minutes and not more than 40 minutes; and the aging treatment step of performing an aging treatment by heating the forged product after the quench treatment step at a temperature of 180° C. to 220° C. for 0.5 hours to 1.5 hours. Therefore, it is possible to produce an Al—Mg—Si-based aluminum alloy forged product excellent in the mechanical property at room temperature and hardly causing recrystallized grains.

EXAMPLES

Next, specific examples of the present invention will be described, but it should be noted that the present invention is not particularly limited to these examples.

Examples 1 to 13

Circular cross-sectional continuously cast materials each having a diameter 54 mm were prepared by aluminum alloys having the alloy compositions shown in Table 1, and subjected to a homogenization heat treatment under the conditions shown in Table 1. The obtained cast materials were subjected to the forging step under the conditions shown in Table 1 to plastically work into the configuration of an automobile suspension arm component shown in FIG. 1.

Next, the automobile suspension arm components were raised in the temperature and subjected to a solution heat treatment under the conditions shown in Table 1. Thereafter, they were subjected to the quench treatment shown in Table 1, and followed by the aging treatment to obtain an aluminum alloy forged product 1.

Comparative Examples 1 to 9

Circular cross-sectional continuously cast materials each having a diameter of 54 mm were prepared by aluminum alloys having the alloy compositions shown in Table 2 were obtained, and subjected to a homogenization heat treatment under the conditions shown in Table 2. The obtained cast materials were subjected to the forging step under the conditions shown in Table 2 to plastically work into the configuration of an automobile suspension arm component shown in FIG. 1.

Next, the automobile suspension arm components were raised in temperature and subjected to a solution heat treatment under the conditions shown in Table 2. Thereafter, they were subjected to the quench treatment shown in Table 2, and followed by the aging treatment to obtain an aluminum alloy forged product 1.

It is assumed that the quenching started when the entire forged product was brought into contact with water.

TABLE 1

| | | | Ex. 1 | Ex. 2 | Ex. 3 | Ex. 4 | Ex. 5 | Ex. 6 | Ex. 7 |
|---|---|---|---|---|---|---|---|---|---|
| Alloy composition | Cu (mass %) | | 0.39 | 0.39 | 0.39 | 0.39 | 0.39 | 0.39 | 0.39 |
| | Mg (mass %) | | 0.8 | 0.8 | 0.8 | 0.8 | 0.8 | 0.8 | 0.8 |
| | Si (mass %) | | 1.14 | 1.14 | 1.14 | 1.14 | 1.14 | 1.14 | 1.14 |
| | Mn (mass %) | | 0.5 | 0.5 | 0.5 | 0.5 | 0.5 | 0.5 | 0.5 |
| | Fe (mass %) | | 0.23 | 0.23 | 0.23 | 0.23 | 0.23 | 0.23 | 0.23 |
| | Cr (mass %) | | 0.13 | 0.13 | 0.13 | 0.13 | 0.13 | 0.13 | 0.13 |
| | Ti (mass %) | | 0.02 | 0.02 | 0.02 | 0.02 | 0.02 | 0.02 | 0.02 |
| | B (mass %) | | 0.004 | 0.004 | 0.004 | 0.004 | 0.004 | 0.004 | 0.004 |
| Conditions/ Evaluations | Homogenization heat treatment step | Temp. [° C.] | 470 | 470 | 470 | 470 | 470 | 470 | 470 |
| | | Holding time [min] | 420 | 420 | 420 | 420 | 420 | 420 | 420 |
| | Forging step | Temp. [° C.] | 500 | 500 | 500 | 500 | 500 | 500 | 500 |
| | Solution heat treatment step | Raising temp. rate [° C./min] | 240 | 240 | 240 | 180 | 180 | 22.5 | 22.5 |
| | | Temp. [° C.] | 545 | 545 | 545 | 545 | 545 | 545 | 545 |
| | | Holding time [min] | 30 | 30 | 30 | 30 | 30 | 30 | 30 |
| | Quench treatment step | Time until immerged [s] | 15 | 15 | 15 | 15 | 15 | 15 | 15 |
| | | Temp. [° C.] | 60 | 60 | 60 | 60 | 60 | 60 | 60 |
| | | Immerged time [min] | 7 | 10 | 15 | 7 | 10 | 7 | 10 |
| | Artificial aging | Temp. [° C.] | 200 | 200 | 200 | 200 | 200 | 200 | 200 |
| | | Holding time [min] | 60 | 60 | 60 | 60 | 60 | 60 | 60 |
| | Proof stress [MPa] | | 387 | 389 | 390 | 382 | 385 | 376 | 377 |
| | Overall Evaluation | | ○ | ○ | ○ | ○ | ○ | ○ | ○ |

| | | | Ex. 8 | Ex. 9 | Ex. 10 | Ex. 11 | Ex. 12 | Ex. 13 |
|---|---|---|---|---|---|---|---|---|
| Alloy composition | Cu (mass %) | | 0.39 | 0.39 | 0.39 | 0.39 | 0.39 | 0.39 |
| | Mg (mass %) | | 0.8 | 0.8 | 0.8 | 0.8 | 0.8 | 0.8 |
| | Si (mass %) | | 1.14 | 1.14 | 1.14 | 1.14 | 1.14 | 1.14 |
| | Mn (mass %) | | 0.5 | 0.5 | 0.5 | 0.5 | 0.5 | 0.5 |
| | Fe (mass %) | | 0.23 | 0.23 | 0.23 | 0.23 | 0.23 | 0.23 |
| | Cr (mass %) | | 0.13 | 0.13 | 0.13 | 0.13 | 0.13 | 0.13 |
| | Ti (mass %) | | 0.02 | 0.02 | 0.02 | 0.02 | 0.02 | 0.02 |
| | B (mass %) | | 0.004 | 0.004 | 0.004 | 0.004 | 0.004 | 0.004 |
| Conditions/ Evaluations | Homogenization heat treatment step | Temp. [° C.] | 470 | 470 | 470 | 470 | 470 | 470 |
| | | Holding time [min] | 420 | 420 | 420 | 420 | 420 | 420 |
| | Forging step | Temp. [° C.] | 500 | 500 | 500 | 500 | 500 | 500 |
| | Solution heat treatment step | Raising temp. rate [° C./min] | 17.5 | 17.5 | 8.75 | 8.75 | 8.75 | 8.75 |
| | | Temp. [° C.] | 545 | 545 | 545 | 545 | 545 | 545 |
| | | Holding time [min] | 30 | 30 | 30 | 30 | 30 | 30 |
| | Quench treatment step | Time until immerged [s] | 15 | 15 | 60 | 60 | 5 | 5 |
| | | Temp. [° C.] | 60 | 60 | 60 | 60 | 60 | 60 |
| | | Immerged time [min] | 7 | 10 | 7 | 10 | 7 | 10 |
| | Artificial aging | Temp. [° C.] | 200 | 200 | 200 | 200 | 200 | 200 |
| | | Holding time [min] | 60 | 60 | 60 | 60 | 60 | 60 |
| | Proof stress [MPa] | | 375 | 377 | 371 | 373 | 376 | 378 |
| | Overall Evaluation | | ○ | ○ | ○ | ○ | ○ | ○ |

TABLE 2

| | | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 | Comp. Ex. 9 |
|---|---|---|---|---|---|---|---|---|---|---|
| Alloy composition | Cu (mass %) | 0.39 | 0.39 | 0.39 | 0.39 | 0.39 | 0.39 | 0.39 | 0.39 | 0.39 |
| | Mg (mass %) | 0.8 | 0.8 | 0.8 | 0.8 | 0.8 | 0.8 | 0.8 | 0.8 | 0.8 |
| | Si (mass %) | 1.14 | 1.14 | 1.14 | 1.14 | 1.14 | 1.14 | 1.14 | 1.14 | 1.14 |
| | Mn (mass %) | 0.5 | 0.5 | 0.5 | 0.5 | 0.5 | 0.5 | 0.5 | 0.5 | 0.5 |
| | Fe (mass %) | 0.23 | 0.23 | 0.23 | 0.23 | 0.23 | 0.23 | 0.23 | 0.23 | 0.23 |
| | Cr (mass %) | 0.13 | 0.13 | 0.13 | 0.13 | 0.13 | 0.13 | 0.13 | 0.13 | 0.13 |
| | Ti (mass %) | 0.02 | 0.02 | 0.02 | 0.02 | 0.02 | 0.02 | 0.02 | 0.02 | 0.02 |
| | B (mass %) | 0.004 | 0.004 | 0.004 | 0.004 | 0.004 | 0.004 | 0.004 | 0.004 | 0.004 |

TABLE 2-continued

| | | | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 | Comp. Ex. 9 |
|---|---|---|---|---|---|---|---|---|---|---|---|
| Conditions/ Evaluations | Homogenization heat treatment step | Temp. [° C.] | 470 | 470 | 470 | 500 | 500 | 500 | 500 | 500 | 500 |
| | | Holding time [min] | 420 | 420 | 420 | 420 | 420 | 420 | 420 | 420 | 420 |
| | Forging step | Temp. [° C.] | 500 | 500 | 500 | 500 | 500 | 500 | 500 | 500 | 500 |
| | Solution heat treatment step | Raising temp. rate [° C./min] | 2.67 | 2.67 | 2.67 | 1.33 | 1.33 | 1.09 | 1.09 | 1.09 | 1.09 |
| | | Temp [° C.] | 545 | 545 | 545 | 545 | 545 | 545 | 545 | 545 | 545 |
| | | Holding time [min] | 30 | 30 | 30 | 30 | 30 | 30 | 30 | 30 | 30 |
| | Quench treatment step | Time until immerged [s] | 15 | 15 | 15 | 15 | 15 | 15 | 15 | 90 | 90 |
| | | Temp. [° C.] | 60 | 60 | 60 | 60 | 60 | 60 | 60 | 60 | 60 |
| | | Immerged time [min] | 0.5 | 1 | 10 | 0.5 | 10 | 7 | 10 | 7 | 10 |
| | Artificial aging | Temp. [° C.] | 200 | 200 | 200 | 200 | 200 | 200 | 200 | 200 | 200 |
| | | Holding time [min] | 60 | 60 | 60 | 60 | 60 | 60 | 60 | 60 | 60 |
| | Proof strees [MPa] | | 362 | 364 | 368 | 359 | 363 | 357 | 358 | 344 | 342 |
| | Overall Evaluation | | Δ | Δ | Δ | × | Δ | × | × | × | × |

Aluminum alloy forged products thus obtained were evaluated according to the evaluation method described below.

<Evaluation of Load Resistance at Room Temperature>

From each obtained aluminum alloy forged product, a tensile test piece of a gauge distance of 25.4 mm, the parallel portion diameter of 6.4 mm was collected, the proof stress was measured by performing the room temperature (25° C.) tensile test of the tensile test piece and evaluated based on the criteria below.

(Criteria)

○: The proof stress at room temperature was equal to or larger than 370 MPa

Δ: The proof stress at room temperature was more than 360 MPa and less than 370 MPa x: The proof stress at room temperature was less than 360 MPa As is clear from Table 1, the aluminum alloy forged products of Examples 1 to 13 produced by the production method of the present invention were excellent in the durability at room temperature.

On the other hand, as shown in Table 2, the aluminum alloy forged products of Comparative Examples 1 to 9, which deviated from the specified range of the present invention, were inferior in durability at room temperature.

INDUSTRIAL APPLICABILITY

The forged product obtained by the production method of an aluminum alloy forged product according to the present invention is excellent in mechanical strength at room temperature, and therefore is suitably used as an undercarriage member, such as, e.g., an automobile suspension arm component, but is not particularly limited to such an application.

This application claims priority to Japanese Patent Application No. 2020-042002, filed on Mar. 11, 2020, the disclosure of which is incorporated herein by reference in its entirety.

The terms and expressions used herein are for illustration purposes only and are not used for limited interpretation, do not exclude any equivalents of the features shown and stated herein, and it should be recognized that the present invention allows various modifications within the scope of the present invention as claimed.

DESCRIPTION OF SYMBOLS

1: Aluminum alloy forged product

What is claimed is:

1. A method of producing an Al—Mg—Si-based aluminum alloy forged product, comprising:

a molten metal forming step of obtaining a molten metal of a 6,000 series aluminum alloy;

a casting step of obtaining a casting by casting the molten metal obtained in the molten metal forming step;

a homogenization heat treatment step of performing a homogenization heat treatment for holding the casting obtained in the casting step at a temperature of 370° C. to 560° C. for 4 hours to 10 hours;

a forging step of obtaining a forged product by subjecting the casting after the homogenization heat treatment step to a forging process at a heating temperature of 450° C. to 560° C.;

a solution heat treatment step of performing a solution heat treatment for heating the forged product obtained in the forging step at a temperature rising rate of 5.0° C./min or more from 20° C. to 500° C. and holding the forged product at 530° C. to 560° C. for 0.3 hours to 3 hours;

a quench treatment step of quenching the forged product in a water tank containing quenching water by bringing an entire surface of the forged product into contact with the quenching water within 5 seconds to 60 seconds after the solution heat treatment step for more than 5 minutes and not more than 40 minutes; and an aging treatment step of performing an aging treatment by heating the forged product after the quench treatment step at a temperature of 180° C. to 220° C. for 0.5 hours to 1.5 hours.

2. The method of producing an Al—Mg—Si-based aluminum alloy forged product as recited in claim 1, wherein the molten metal of the 6,000 series aluminum alloy consists of: Cu: 0.15 mass % to 1.0 mass %; Mg: 0.6 mass % to 1.15 mass %; Si: 0.95 mass % to 1.25 mass %; Mn: 0.4 mass % to 0.6 mass %; Fe: 0.2 mass % to 0.3 mass %; Cr: 0.11 mass % to 0.25 mass %; Ti: 0.012 mass % to 0.035 mass %; B: 0.0001 mass % to 0.03 mass %; Zn: 0.25 mass % or less; Zr: 0.05 mass % or less; and the balance being Al and inevitable impurities.

3. The method of producing an Al—Mg—Si-based aluminum alloy forged product as recited in claim 2,
wherein a content of the Zn is 0 mass %.

4. The method of producing an Al—Mg—Si-based aluminum alloy forged product as recited in claim 2,
wherein a content of Zr is 0 mass %.

5. The method of producing an Al—Mg—Si-based aluminum alloy forged product as recited in claim 3,
wherein a content of Zr is 0 mass %.

6. The method of producing an Al—Mg—Si-based aluminum alloy forged product as recited in claim 1,
wherein the forged product is an automobile suspension member.

7. The method of producing an Al—Mg—Si-based aluminum alloy forged product as recited in claim 2,
wherein the forged product is an automobile suspension member.

8. The method of producing an Al—Mg—Si-based aluminum alloy forged product as recited in claim 3,
wherein the forged product is an automobile suspension member.

9. The method of producing an Al—Mg—Si-based aluminum alloy forged product as recited in claim 4,
wherein the forged product is an automobile suspension member.

10. The method of producing an Al—Mg—Si-based aluminum alloy forged product as recited in claim 5,
wherein the forged product is an automobile suspension member.

11. The method of producing an Al—Mg—Si-based aluminum alloy forged product as recited in claim 1,
wherein the quench treatment step of quenching the forged product in a water tank containing quenching water is by bringing an entire surface of the forged product into contact with the quenching water within 5 seconds to 60 seconds after the solution heat treatment step for more than 7 minutes and not more than 15 minutes.

12. The method of producing an Al—Mg—Si-based aluminum alloy forged product as recited in claim 1,
wherein the quench treatment step of quenching the forged product in a water tank containing quenching water is by bringing an entire surface of the forged product into contact with the quenching water within 5 seconds to 60 seconds after the solution heat treatment step for more than 7 minutes and not more than 10 minutes.

13. The method of producing an Al—Mg—Si-based aluminum alloy forged product as recited in claim 1,
wherein the quench treatment step of quenching the forged product in a water tank containing quenching water is by bringing an entire surface of the forged product into contact with the quenching water within 15 seconds to 60 seconds after the solution heat treatment step for more than 5 minutes and not more than 40 minutes.

14. The method of producing an Al—Mg—Si-based aluminum alloy forged product as recited in claim 1,
wherein the quench treatment step of quenching the forged product in a water tank containing quenching water is by bringing an entire surface of the forged product into contact with the quenching water within 15 seconds to 60 seconds after the solution heat treatment step for more than 7 minutes and not more than 15 minutes.

15. The method of producing an Al—Mg—Si-based aluminum alloy forged product as recited in claim 1,
wherein the quench treatment step of quenching the forged product in a water tank containing quenching water is by bringing an entire surface of the forged product into contact with the quenching water within 15 seconds to 60 seconds after the solution heat treatment step for more than 7 minutes and not more than 10 minutes.

16. The method of producing an Al—Mg—Si-based aluminum alloy forged product as recited in claim 1,
wherein the quench treatment step of quenching the forged product in a water tank containing quenching water is by bringing an entire surface of the forged product into contact with the quenching water 60 seconds after the solution heat treatment step for more than 5 minutes and not more than 40 minutes.

17. The method of producing an Al—Mg—Si-based aluminum alloy forged product as recited in claim 1,
wherein the quench treatment step of quenching the forged product in a water tank containing quenching water is by bringing an entire surface of the forged product into contact with the quenching water 60 seconds after the solution heat treatment step for more than 7 minutes and not more than 15 minutes.

18. The method of producing an Al—Mg—Si-based aluminum alloy forged product as recited in claim 1,
wherein the quench treatment step of quenching the forged product in a water tank containing quenching water is by bringing an entire surface of the forged product into contact with the quenching water 60 seconds after the solution heat treatment step for more than 7 minutes and not more than 10 minutes.

* * * * *